US012656040B2

(12) United States Patent
Kim et al.

(10) Patent No.: US 12,656,040 B2
(45) Date of Patent: Jun. 16, 2026

(54) REFRIGERATOR AND CONTROL METHOD THEREFOR

(71) Applicant: LG Electronics Inc., Seoul (KR)

(72) Inventors: Yonghyun Kim, Seoul (KR); Sooyoung Choi, Seoul (KR); Sunghee Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 189 days.

(21) Appl. No.: 18/531,309

(22) Filed: Dec. 6, 2023

(65) Prior Publication Data

US 2024/0302090 A1 Sep. 12, 2024

(30) Foreign Application Priority Data

Mar. 6, 2023 (KR) ..... 10-2023-0029193

(51) Int. Cl.
*F25C 1/25* (2018.01)

(52) U.S. Cl.
CPC ..... *F25C 1/25* (2018.01); *F25C 2400/14* (2013.01)

(58) Field of Classification Search
CPC ..... F25C 1/25; F25C 2400/14
See application file for complete search history.

(56) References Cited

U.S. PATENT DOCUMENTS

2021/0071928 A1* 3/2021 Chernov ..... F25C 1/25

FOREIGN PATENT DOCUMENTS

EP 3789698 A1 * 3/2021 ..... F25C 1/25
KR 10-2005-0119434 12/2005

* cited by examiner

*Primary Examiner* — Cassey D Bauer
(74) *Attorney, Agent, or Firm* — Fish & Richardson P.C.

(57) ABSTRACT

A refrigerator includes a cabinet, a door, an ice maker provided in the cabinet or the door, a water supply flow path configured to connect the ice maker to a water supply source outside the cabinet, a filter connected to the water supply flow path to purify water supplied to the ice maker, at least one valve provided in the water supply flow path, and a controller configured to control operation of the ice maker and the valve. The water supply flow path includes an ice maker pipe connected to the ice maker to supply water for ice making and a drain pipe configured to drain water in the water supply flow path to outside of the cabinet. The controller controls the valve to block water supply to the ice maker and drain water through the drain pipe when a drain signal is input.

18 Claims, 10 Drawing Sheets

REFRIGERATOR AND CONTROL METHOD THEREFOR

CROSS-REFERENCE TO RELATED APPLICATIONS

The present application claims the benefit under 35 U.S.C. § 119 of Korean Patent Application No. 10-2023-0029193, filed on Mar. 6, 2023, which is hereby incorporated by reference in its entirety.

BACKGROUND

Embodiments of the present disclosure relate to a refrigerator and a control method therefor.

In general, refrigerators are home appliances that allow low-temperature storage of food in an internal storage space shielded by a door, and are configured to store food in an optimal condition by cooling the interior of the storage space using cold air generated through heat exchange with refrigerant circulating with freezing cycles.

In addition, refrigerators are becoming larger and more multifunctional as dietary habits change and user preferences diversify, and various configurations are being added for user convenience.

For example, an ice maker capable of making ice by automatic water supply may be provided in a refrigerator. In addition, a dispenser for dispensing purified cold water from the outside while the refrigerator door is closed may be provided.

Representatively, Korea Patent Publication No. 10-2005-0119434 discloses a refrigerator in which water supplied from the outside is branched by a valve and supplied to an ice maker and dispenser. In order to purify the water supplied to the ice maker and the dispenser in the refrigerator, a filter may be further provided on a water flow path supplied to the ice maker and the dispenser.

Meanwhile, the refrigerator may not be equipped with a dispenser and may only be equipped with an ice maker. In this case, water from a water supply source may be supplied to the ice maker through the filter. However, in such refrigerators, there is a problem that foreign substances in the filter may be supplied to the ice maker after the filter is replaced, and foreign substances or contaminated water in the water supply flow path cannot be discharged, which may cause problems with the quality of ice making.

SUMMARY

An embodiment of the present disclosure provides a refrigerator and a control method therefor, which discharge foreign substances and contaminated water present in a water supply flow path of the refrigerator.

An embodiment of the present disclosure provides a refrigerator and a control method therefor, which discharge foreign substances generated when replacing a filter.

An embodiment of the present disclosure provides a refrigerator and a control method therefor, which discharge foreign substances and contaminated water from a water supply flow path in a refrigerator that is not equipped with a dispenser and is equipped with only an ice maker.

An embodiment of the present disclosure provides a refrigerator and a control method, which discharge contaminated water when water in a water supply flow path is contaminated due to non-supply of water for a long period of time.

According to an aspect of the present disclosure, a refrigerator includes a cabinet having a storage space formed therein, a door configured to open and close the storage space, an ice maker provided in the cabinet or the door, a water supply flow path configured to connect the ice maker to a water supply source outside the cabinet, a filter connected to the water supply flow path to purify water supplied to the ice maker, at least one valve provided in the water supply flow path, and a controller configured to control operation of the ice maker and the valve, wherein the water supply flow path includes an ice maker pipe connected to the ice maker to supply water for ice making, and a drain pipe configured to drain water in the water supply flow path to outside of the cabinet, and the controller is configured to control the valve to block water supply to the ice maker and drain water through the drain pipe when a drain signal is input.

The valve may include an ice maker valve provided in the ice maker pipe, and a drain valve provided in the drain pipe.

The ice maker valve and drain valve may be provided in a refrigerating compartment formed inside the cabinet.

The filter may be provided inside the refrigerating compartment.

The filter may be provided outside the cabinet, be disposed and be connected between the water supply source and the cabinet by the water supply flow path.

The valve may be connected to the ice maker pipe and the drain pipe, and may include a switching valve operated by the controller to switch the flow path to one of the ice maker pipe or the drain pipe.

The valve may be provided between the water supply source and the filter, and may further include a water supply valve configured to open and close a flow path supplied to the filter.

The water supply flow path may be provided with a flow sensor, and the controller may determine end of drain through the drain pipe according to an amount of water detected by the flow sensor.

The refrigerator may further include a timer configured to count time and the controller may determine end of drain through the drain pipe when the time counted by the timer has elapsed by more than the set time after starting drain through the drain pipe.

The cabinet may include a refrigerating compartment in which a filter is placed, a freezing compartment in which the ice maker is placed, and a machine room in which a compressor is placed, and the valve may include a water supply valve provided in the machine room and communicating with an outlet side of the water supply source, an ice maker valve provided in the refrigerating compartment and connected to the ice maker pipe, and a drain valve provided in the refrigerating compartment and connected to the drain pipe. The ice maker flow path and a drain flow path enter and exit through rear of the cabinet.

The refrigerator may further include an operating part through which a user performs input and operation, and the controller may control the valve according to the operation of the operating part to drain water through a drain portion.

The refrigerator may further include a detector configured to detect mounting of the filter, and the controller may control the valve to drain water through a drain part according to detection of the detection device.

The refrigerator may further include a timer configured to count time, and the controller may drain water through a drain part when water is not supplied for more than a set time in the timer after water is supplied to the ice maker.

The drain pipe may extend to outside of the cabinet through a rear of the cabinet.

An aspect of the present disclosure, a control method for a refrigerator, the refrigerator including a filter and at least one valve provided in a water supply flow path connecting a water supply source and an ice maker and the water supply flow path including an ice maker pipe connected to the ice maker and a drain pipe that drains water to outside of the refrigerator, the method includes starting a drain mode when a drain signal is input, turning on the valve to open the drain pipe, determining whether drain is completed, and ending the drain mode by turning off the valve to close the drain pipe when it is determined that the drain is completed.

The method may further include determining that the drain is completed when an amount of water supplied to the water supply source and detected by a flow sensor is greater than or equal to a set amount of water or when a set time has elapsed after the valve is turned on.

The drain signal may be input when the filter is replaced.

The drain signal may be input when water is not supplied to the ice maker for a set time after water supply to the ice maker has been completed.

Water supply to the ice maker may be started after the drain mode ends when a water supply signal for the ice maker is input in a state in which the drain mode is started.

The drain mode may be started after water supply to the ice maker has been completed when the drain signal is input in a state in which water supply to the ice maker is started.

The refrigerator and the control method therefor according to the embodiment of the present disclosure may be expected to have the following effects.

In the refrigerator and the control method therefor according to the embodiment of the present disclosure, water is drained through the drain pipe even in situations where foreign substances or contamination may occur on the water supply flow path, such as replacement of a filter, thereby cleaning the water supply flow path and internal components thereof and removing contamination to improve hygiene.

In particular, the removal of unavoidable foreign substances generated when installing a filter, such as activated carbon residue generated when replacing a new filter, can be guaranteed. Therefore, even in models without a dispenser and equipped with an ice maker alone, foreign substances during filter replacement can be effectively removed, thus solving problems that occur when replacing a filter.

In addition, even when water is not supplied to the ice maker for a long time, old water in the water supply flow path may be automatically drained without separate operation, thereby ensuring the sanitary condition of the water in the water supply flow path.

In particular, it is possible to prevent the ice maker's ice-making quality from deteriorating when there is no separate water drain path in the water supply flow path other than the ice maker, and provide hygienic ice.

In addition, it is possible to drain an appropriate amount of water through the drain pipe, and it is ensured that an appropriate amount of water is drained even when the flow sensor is abnormal, thereby maintaining hygiene and preventing excessive water use.

DETAILED DESCRIPTION OF THE EMBODIMENTS

Figure 1:
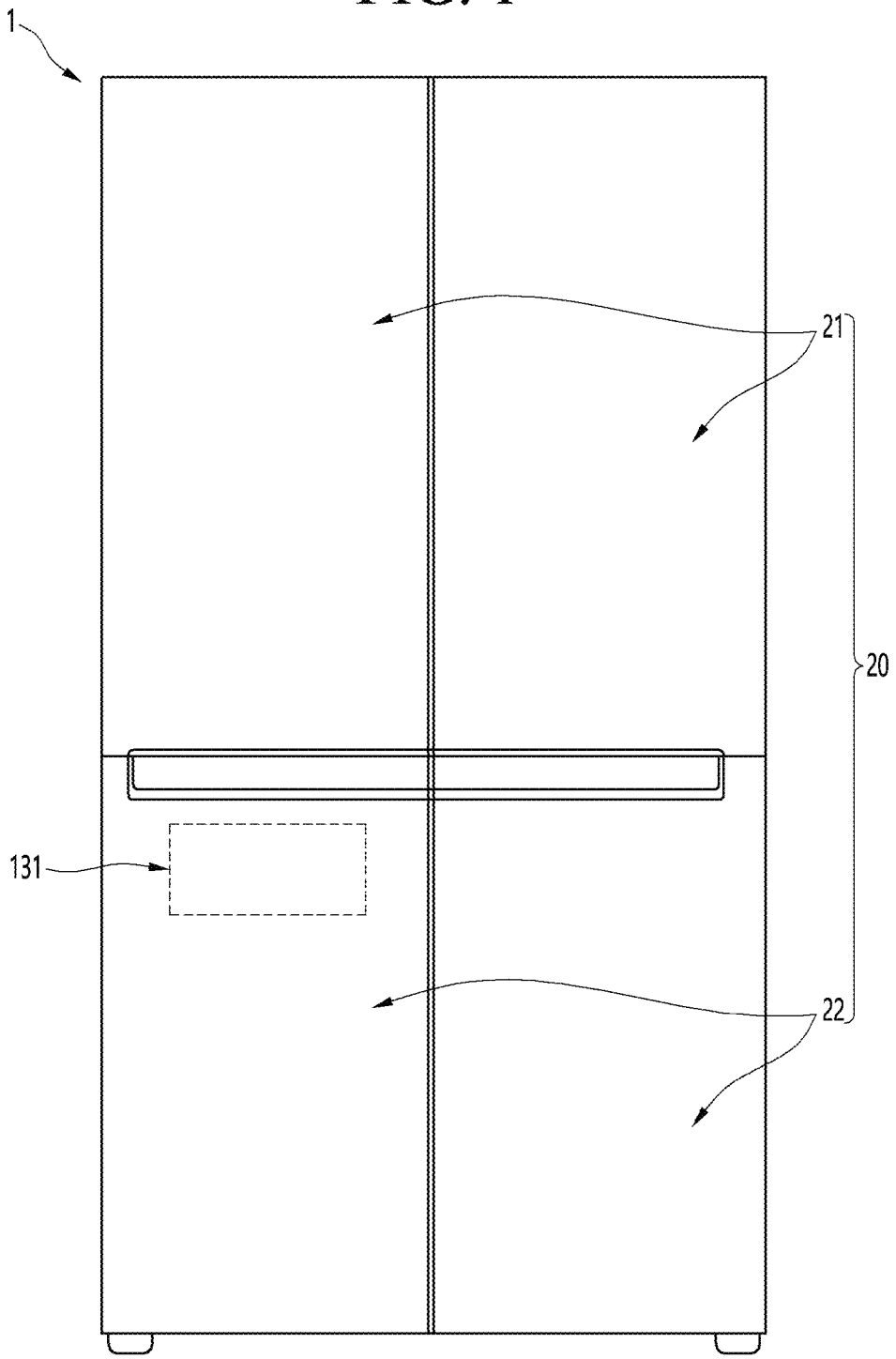
FIG. 1 is a front view of a refrigerator according to an embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. In addition, in describing embodiments of the present disclosure, a detailed description of known configurations or functions thereof will be omitted when it is determined that it is obvious to those skilled in the art.

Before making a description, directions are defined. In an embodiment that will be described below, a direction facing a front surface of a door illustrated in FIG. 1 may be defined as a front direction unless the direction is separately defined, a direction facing the inside of a cabinet with respect to the front surface of the door will be defined as a rear direction, a direction facing a bottom surface on which a refrigerator is installed will be defined as a downward direction, and a direction that is away from the bottom surface will be defined as an upward direction. Of course, if necessary, the directions may be redefined and description is given based on each drawing.

Figure 2:
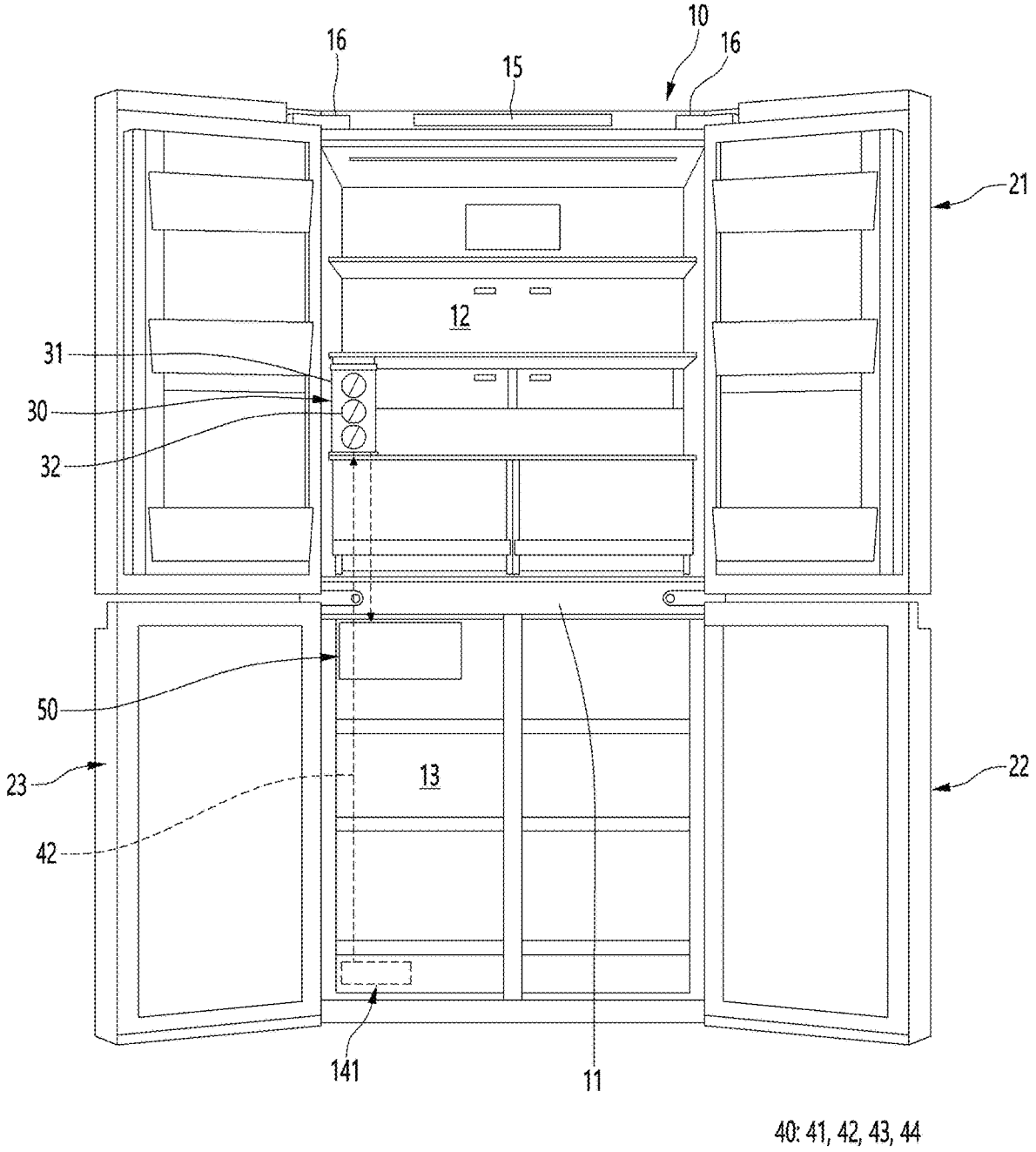
FIG. 2 is a view of the refrigerator when a refrigerator door is opened.
Figure 3:
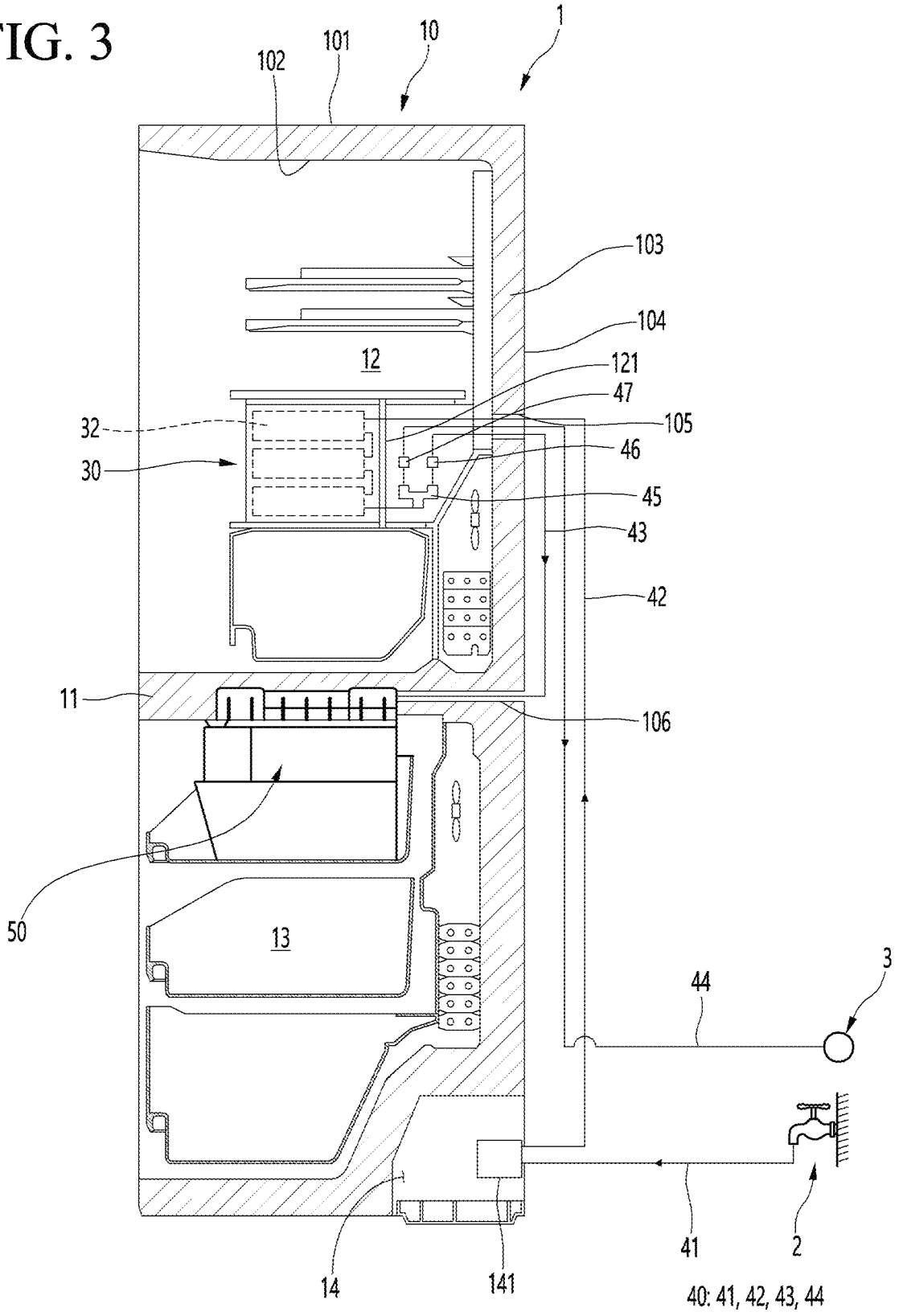
FIG. 3 is a cross-sectional view showing an arrangement structure of a water supply flow path of the refrigerator.
Figure 4:
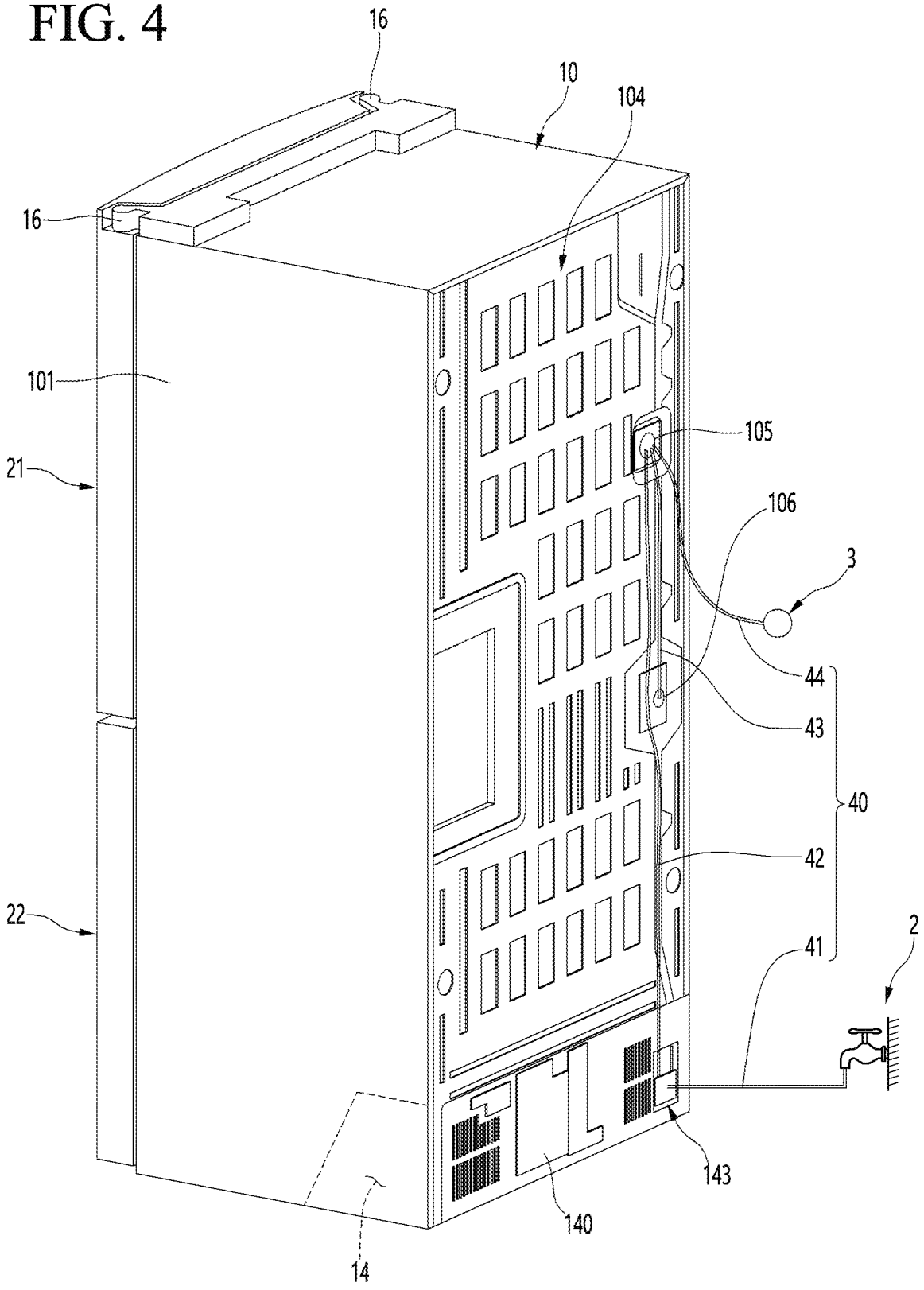
FIG. 4 is a rear view of the refrigerator.

FIG. 1 is a front view of a refrigerator according to an embodiment of the present disclosure. FIG. 2 is a view of the refrigerator when a refrigerator door is opened. FIG. 3 is a cross-sectional view showing an arrangement structure of a water supply flow path of the refrigerator. FIG. 4 is a rear view of the refrigerator.

As illustrated in FIGS. 1 to 4, a refrigerator 1 according to an embodiment of the present disclosure may include a cabinet 10 configured to open or close a storage space, and a door 20 configured to open and close the storage space.

The storage space may be divided into upper and lower sections by a barrier 11, and may include a refrigerating compartment 12 provided above the barrier 11 and a freezing compartment 13 provided below the barrier 11. In addition, a machine room 14 in which a compressor and a condenser are located may be provided at the rear bottom of the cabinet 10. The open rear side of the machine room 14 may be shielded by a machine room cover 140.

The cabinet 10 may include an outer case 101 forming the exterior, an inner case 102 forming the storage space, and a thermal insulating material 103 filled between a space between the outer case 101 and the inner case 102. Further, the rear side of the cabinet 10 may be formed by a back cover 104.

The door 20 may include a refrigerating compartment door 21 that opens and closes the refrigerating compartment 12 and a freezing compartment door 22 that opens and closes the freezing compartment 13. The refrigerating compartment door 21 may be rotatably mounted on the cabinet 10 by being connected to the cabinet 10 by a hinge device 16. In addition, a pair of the refrigerator compartment doors 21 may be rotatably provided on both left and right sides, respectively.

The freezing compartment door 22 may also be rotatably mounted like the refrigerating compartment door 21. Furthermore, a pair of the freezing compartment doors 22 may be provided on both left and right sides. The freezing compartment door 22 may be configured to be drawn in and out in a drawer type.

Meanwhile, an operating part 15 may be formed in the cabinet 10. The operating part 15 may allow a user to operate and input the operation of the refrigerator 1. As an example, the operating part 15 may input a drain mode operation that drains water from the water supply flow path 40. The operating part 15 may be configured as a touch display to display the operating status of the refrigerator 1. In addition, the operating part 15 may be provided with a separate display.

The operating part 15 may be provided at the top of the front of the cabinet 10 and exposed when the door 20 is opened. As another example, the operating part 15 may be provided on the front of the door 20.

Meanwhile, the refrigerating compartment 12 may be equipped with a filter 30, and the freezing compartment 13 may be equipped with an ice maker 50. A water supply source 2 outside the cabinet 10 may be connected to and the filter 30 and ice maker 50 through a water supply flow path. Accordingly, the water supplied from the water supply source 2 may be purified through the filter 30 and then supplied to the ice maker 50 through at least one valve 46, 47, or 141. A controller 17 may control the operations of the ice maker 50 and the valves 46, 47, and 141.

Specifically, the machine room 14 may be provided with a water supply valve 141. In addition, the machine room 14 may be further equipped with a flow sensor 142. The flow sensor 142 may be integrated with the water supply valve 141. The water supply valve 141 may be connected to the water supply source 2 outside the cabinet 10 through a water supply pipe 41 constituting the water supply flow path 40. That is, water supplied from the water supply source 2 may flow into the refrigerator 1 through the water supply valve 141. As an example, the water supply source 2 may be connected to a water faucet connected to a water supply source or a pipe or device through which water is supplied in the home.

The flow sensor 142 may detect an amount of water flowing in through the water supply valve 141. A fixed amount of water may be supplied to the ice maker 50 according to the amount of water detected by the flow sensor 142. The end of the drain mode operation, which will be described below, may be determined based on the amount of water detected by the flow sensor 142. Accordingly, the flow sensor 142 may be located in another location of the water supply flow path 40 that satisfies the above-described function, not in in the machine room 14.

The filter 30 may be used to purify water supplied to the ice maker 50 and may be provided inside the refrigerating compartment 12. Of course, the filter 30 may also be provided outside the storage space.

The filter 30 may be in communication with the water supply valve 141 or the flow sensor 142 through a filter pipe 42 constituting the water supply flow path 40. That is, water passing through the water supply valve 141 or the flow sensor 142 may be supplied to the filter 30 through the filter pipe 42. The filter pipe 42 may connect a plurality of filtering members 32, and may also connect the filter 30 and a branch pipe 45.

The filter 30 may be mounted inside the refrigerating compartment 12 and may include a case 31 that forms the exterior, and one or more filtering members 32 that are mounted inside the case 31 and purify water. The filtering member 32 may be detachable from the case 31. Accordingly, a user may maintain purification performance for water supplied to the ice maker 50 by replacing the filtering member 32. The filter 30 is referred to as including a filtering member 32, and replacement of the filter 30 may mean replacement of the filtering member 32.

The branch pipe 45, an ice maker valve 46, and a drain valve 47 may be provided in the refrigerating compartment 12. The inlet of the branch pipe 45 may be connected to the end of the water supply flow path 40, that is, the filter pipe 42, and may be branched into two outlets.

An ice maker pipe 43 connected to the ice maker 50 and a drain pipe 44 for draining water washed the inside of the water supply flow path 40 are connected to the pair of outlets of the branch pipe 45, respectively.

The ice maker pipe 43 may be provided with the ice maker valve 46, enabling selective water supply to the ice maker 50. In addition, the drain pipe 44 may be provided with the drain valve 47, enabling selective drainage through the drain pipe 44.

Meanwhile, the branch pipe 45, the ice maker valve 46, and the drain valve 47 may be disposed in the rear space of the filter 30. Additionally, the branch pipe 45, the ice maker valve 46, and the drain valve 47 may be shielded by a valve cover 121 disposed inside the refrigerating compartment 12. Meanwhile, the ice maker valve 46 and drain valve 47 may be disposed in a location other than the refrigerating compartment 12, if necessary. For example, the ice maker valve 46 and the drain valve 47 may be disposed at the rear of the cabinet 10.

The ice maker 50 may be provided in the freezing compartment 13. The ice maker 50 may be an automatic ice maker in which water is automatically supplied to make ice, and the generated ice is transferred. As an example, the ice maker 50 may make spherical ice and may be called a spherical ice maker. The ice maker 50 may need to be supplied with an accurate amount of water in order to make spherical ice. Of course, the ice maker 50 is not limited to an ice maker that makes spherical ice, and may be another ice maker that requires a fixed amount of water supply.

The ice maker 50 may be mounted on the upper surface of the freezing compartment 13 to facilitate water supply. Accordingly, the ice maker pipe 43 that supplies water to the ice maker 50 may be directed to the ice maker 50 by passing through the barrier 11.

Meanwhile, the water supply valve 141, the filter 30, the ice maker valve 46, the drain valve 47, and the ice maker 50 may be arranged in a vertical direction on either the left or right sides of the cabinet 10. In addition, the water supply valve 141, the filter 30, the ice maker valve 46, the drain valve 47, and the ice maker 50 may be arranged on the same extension line in the vertical direction so that the water supply flow path 40 connecting them may be placed as the shortest path.

The water supply flow path 40 may enter and exit through the rear of the back cover 104, and may be be connected to the water supply valve 141, the filter 30, the ice maker valve 46, the drain valve 47, and ice maker 50.

Specifically, the water supply flow path 40 may include the water supply pipe 41 connecting the water supply source 2 and the water supply valve 141, the filter pipe 42 connecting the water supply valve 141 or the flow sensor 142 and the filter 30, the ice maker pipe 43 connected to the ice maker 50, and the drain pipe 44 configured to perform drain to the outside of the cabinet 10.

In addition, a first opening 143, a second opening 105, and a third opening 106 may be formed in the rear of the cabinet 10. The first opening 143, the second opening 105, and the third opening 106 may be arranged in the vertical direction on the same extension line.

The first opening 143 may be formed in the machine room cover 140. The first opening 143 may be formed at a position corresponding to the water supply valve 141. Furthermore, through the first opening 143, the water supply pipe 41 may enter the inside of the machine room 14 and the filter pipe 42 may exit the machine room 14.

The second opening 105 may be formed above the first opening 143 and the third opening 106. The second opening 105 may be formed in the back cover 104. The second opening 105 may be formed on the rear side corresponding to the positions of the ice maker valve 46, the drain valve 47, and the filter 30. In addition, the filter pipe 42 may enter the inside of the cabinet 10 and the ice maker pipe 43 and the drain pipe 44 may exit the cabinet 10, through the second opening 105.

The drain pipe 44 may extend long through the rear of the cabinet 10, and may be connected to the home sewer 3 or a device or pipe connected to the sewer to drain water from the water supply flow path 40.

The third opening 106 may be formed above the first opening 143. The third opening 106 may be formed in the back cover 104. The third opening 106 may be formed at a position corresponding to the rear end of the barrier 11. Also, the ice maker pipe 43 may enter the cabinet 10 through the third opening 106. The ice maker pipe 43 may extend along the barrier 11 and then protrude toward the ice maker 50 at the end thereof.

Hereinafter, the operation of the refrigerator 1 having the above-described structure will be described in more detail with reference to the drawings.

Figure 5:
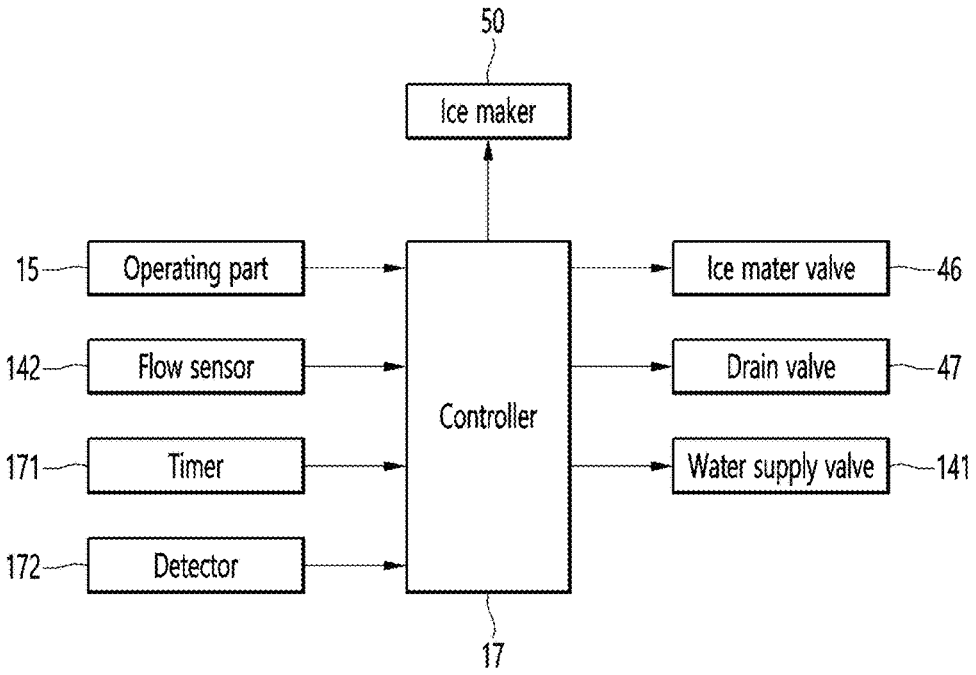
FIG. 5 is a block diagram showing the flow of a control signal of a refrigerator.
Figure 6:
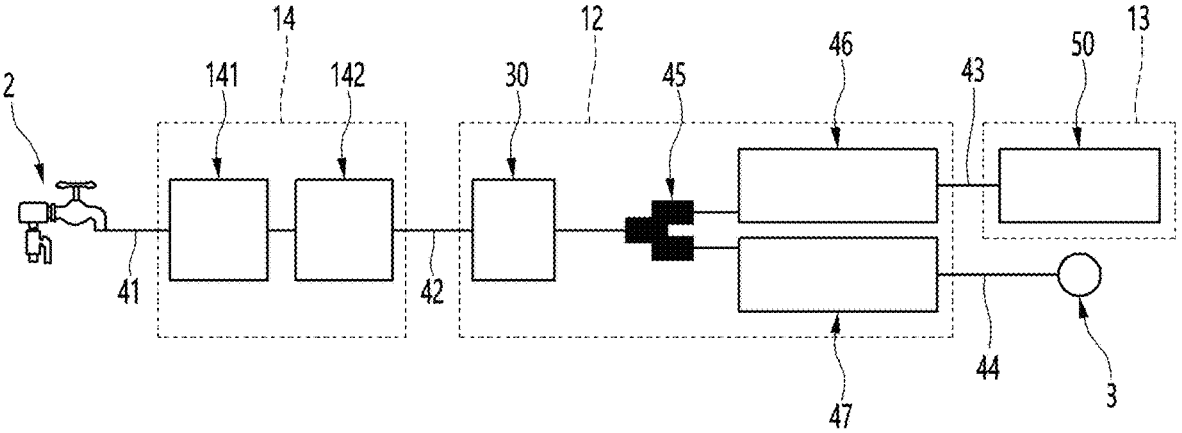
FIG. 6 is a diagram schematically showing the entire flow path connection state and water flow state of a refrigerator.
Figure 7:
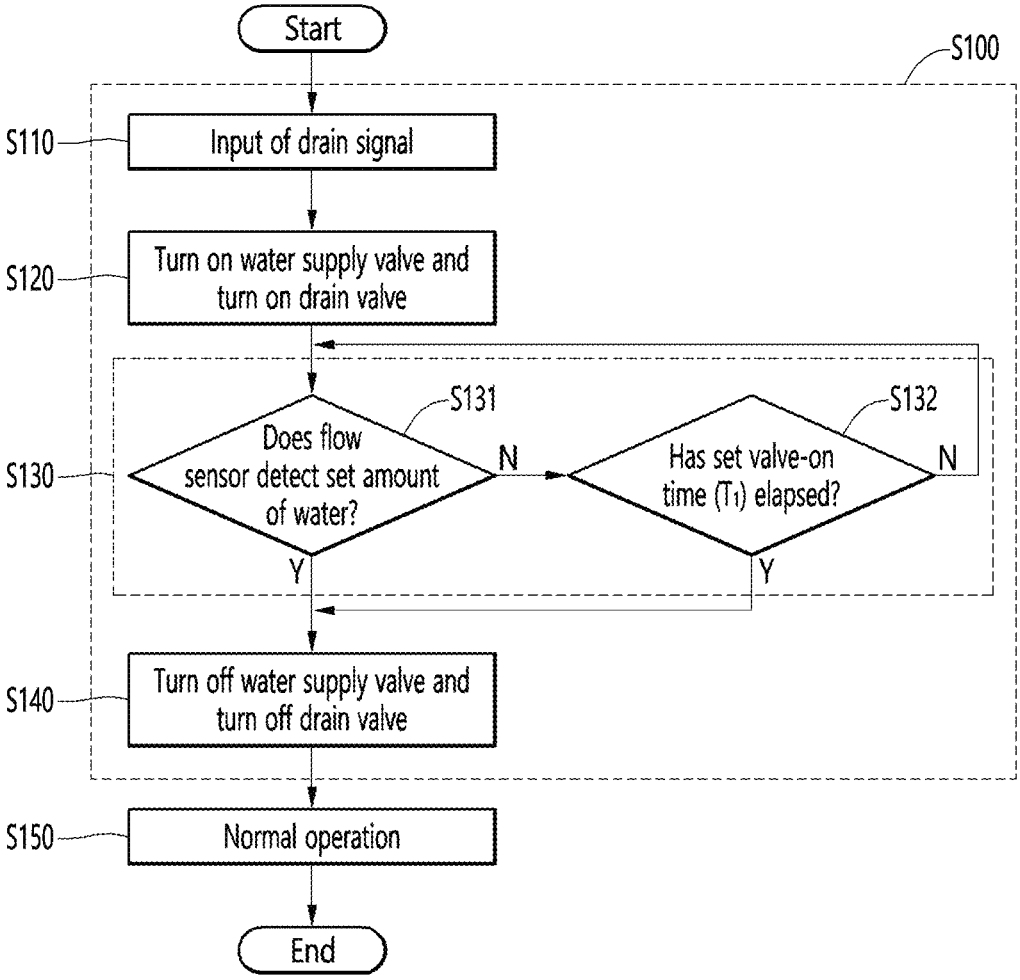
FIG. 7 is a flowchart showing the drain mode operation of a refrigerator.

FIG. 5 is a block diagram showing the flow of a control signal of a refrigerator. FIG. 6 is a diagram schematically showing the entire flow path connection state and water flow state of a refrigerator. In addition, FIG. 7 is a flowchart showing the drain mode operation of a refrigerator.

As shown in the drawings, water supplied from the water supply source 2 may be supplied into the inside of the refrigerator 1 through the water supply flow path 40. In addition, the water supplied into the refrigerator 1 may be filtered by the filter 30 and then supplied to the ice maker 50. Furthermore, when the drain mode operation is necessary, water in the inside of the water supply flow path 40 may be discharged to the outside of the refrigerator 1 through the drain pipe 44.

Specifically, water from the water supply source 2 may flow into the water supply valve 141 through the water supply pipe 41. As the water supply valve 141 is opened (ON), water from the water supply source 2 may flow along the water supply flow path 40 due to the supplied water pressure and be supplied.

Water passing through the water supply source 2 may pass through the flow sensor 142, and the flow sensor 142 may detect the amount of water supplied into the refrigerator 1. In this case, when water is supplied to the ice maker 50, the amount of water for constant supply may be detected. Additionally, when water is supplied to the drain pipe 44, the amount of water may be detected to determine whether the drain mode operation had been completed.

Water that has passed through the flow sensor 142 may be supplied to the filter 30 through the filter pipe 42. In addition, the water supplied through the filter pipe 42 may be purified while passing through the filter 30. In this case, the filter 30 may require periodic replacement and management to maintain effective water purification and water purification performance.

The water purified through the filter 30 may be branched by the branch pipe 45 and supplied to the ice maker pipe 43 and the drain pipe 44, respectively. The ice maker valve 46 and drain valve 47 may be controlled by the controller 17 according to the operation mode of the refrigerator 1. In addition, water may be supplied to the ice maker 50 or water from the refrigerator may be drained to the outside through the drain pipe 44, according to the opening/closing (ON/OFF) of the ice maker valve 46 and the drain valve 47.

In a normal state, the ice maker valve 46 is opened (ON), and water is supplied to the ice maker 50 through the ice maker pipe 43, so that ice making operation may be performed in the ice maker 50. In this case, the drain valve 47 may be maintained in a closed (OFF) state, making it impossible for water to flow through the drain pipe 44. This state may be called ice-making mode, normal mode, or normal operation.

Meanwhile, the refrigerator 1 may need to drain water in the water supply flow path 40 during use. For example, when the filter 30 is replaced with a new filter, foreign substances, such as activated carbon in the filter 30, may need to be discharged. To this end, after the filter 30 has been replaced, a drain mode operation may be performed in which the water in the water supply flow path 40 is forcibly drained to the drain pipe 44. During the drain mode operation, the water supply flow path 40 and elements connected thereto may be cleaned while water is supplied from the water supply source 2, which may be referred to as a flushing mode operation.

The drain mode operation may be started by the input of a drain signal. The drain signal may be input by manipulating the operating part 15. The user may directly input the drain signal through manipulation of the operating part 15 when the drain mode operation is required, such as replacement of the filter 30. Of course, when a detector 172 that detects the installation of the filter 30 is provided, the drain signal may be automatically input according to detection by the detector. [S110]

When the drain signal is input to the controller 17, the controller 17 may open the water supply valve 141 and the drain valve 47. In this case, the ice maker valve 46 may be closed. Accordingly, the water supplied from the water supply source 2 may pass through the water supply valve 141, the filter 30, and the drain valve 47 and may be then drained out of the refrigerator 1 through the drain pipe 44. [S120]

The drain valve 47 may be continuously maintained in an open state to ensure that the filter 30 is sufficiently cleaned.

In addition, a sufficient amount of water may be drained for a sufficient period of time such that no foreign substances remain in the filter 30 as well as the water supply flow path 40.

As an example, the flow sensor 142 may detect the amount of water supplied after the drain valve 47 is opened. The drain valve 47 may be maintained in the opened state to continuously remain a drain state until the amount of water detected by the flow sensor 142 reaches a set amount of water. In this case, the set amount of water may be set to an amount of water sufficient to clean the filter 30 and discharge foreign substances in the water supply flow path. For example, the set amount of water may be approximately 10 L, and a pulse value of the flow sensor corresponding to the set amount of water may be 40,000. That is, the controller 17 may determine the end of the drain mode operation based on the amount of water detected by the flow sensor 142. [S131 (S130)]

In addition, when a timer 171 for counting time is provided, time may be counted when the drain valve 47 is opened. The drain valve 47 may be maintained in the opened state to continuously maintain a drain state until the time counted by the timer 171 reaches a set time. In this case, the set time T1 may be set to a time sufficient for cleaning the filter 30 and discharging foreign substances in the water supply flow path 40. As an example, the set time T1 may be approximately 10 minutes. That is, the controller 17 may determine the end of the drain mode operation based on the flow path of time detected by the timer 171. [S132 (S130)]

When the amount of water of the flow sensor 142 reaches the set amount of water or the time counted by the timer reaches the set time T1, the water supply valve 141 and the drain valve 47 may be closed to end the drain mode operation.

That is, even when the amount of water of the flow sensor 142 does not reach the set amount of water, the water supply valve 141 and the drain valve 47 may be closed when the time counted by the timer 171 reaches the set time T1. Accordingly, it is possible to prevent problems such as draining an excessive amount of water or failing to return to ice-making mode operation in the event of a misdetection or failure of the flow sensor 142. [S140]

When the water supply valve 141 and the drain valve 47 are turned off, the controller 17 may instruct the refrigerator 1 to operate normally. In this state, the water supply valve 141, the ice maker valve 46, and the drain valve 47 may all be closed and standby for the next operation. For example, in the normal operation state, when an ice-making signal is input, an ice-making mode operation may be performed in which ice-making operation is performed by supplying water to the ice maker 50. [S150]

Hereinafter, an operation state when the water supply signal of the ice maker 50 is generated during the drain mode operation will be described with reference to the drawings.

Figure 8:
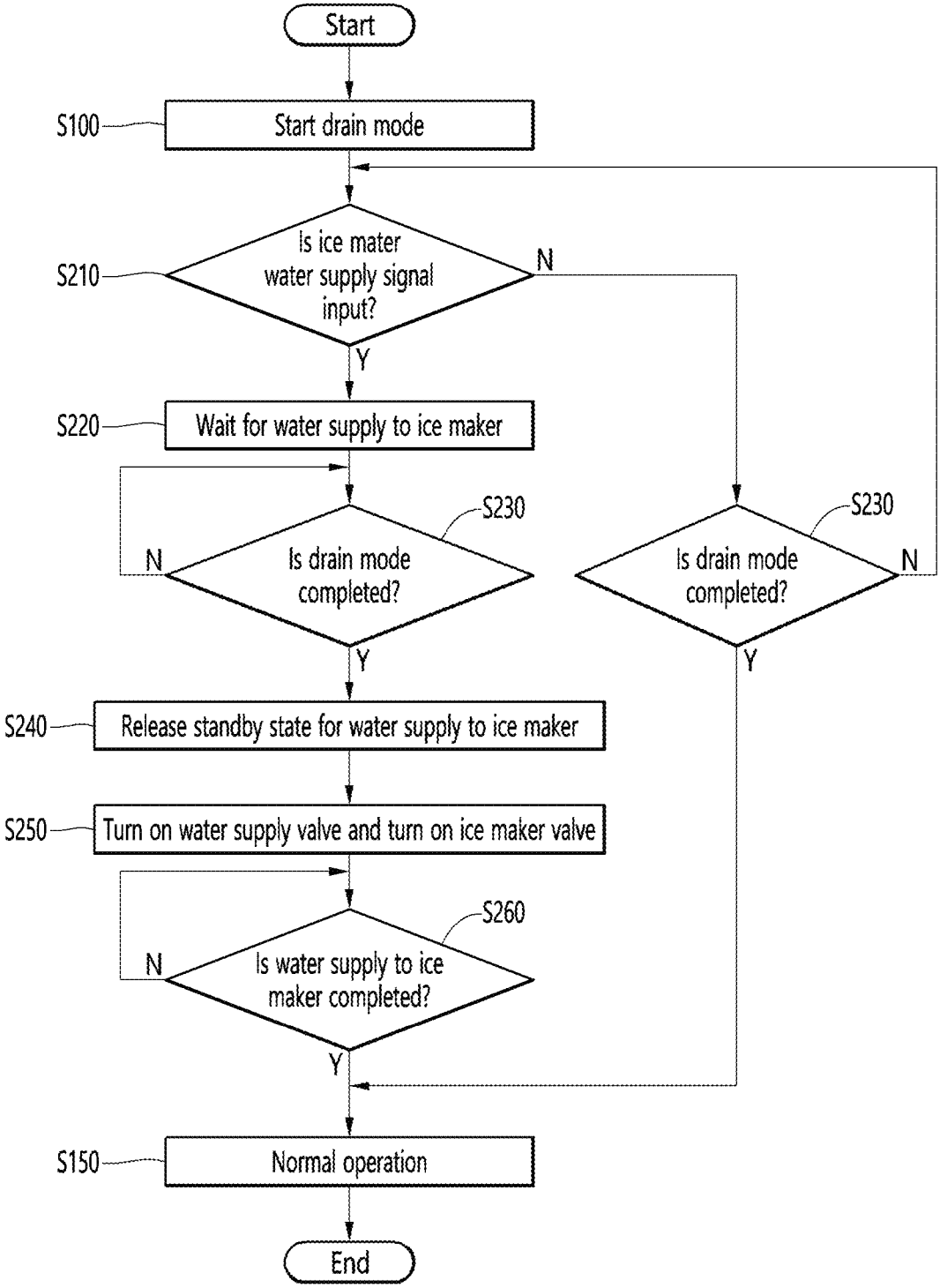
FIG. 8 is a flowchart showing operations when an ice maker water supply signal is generated during the drain mode of a refrigerator.

FIG. 8 is a flowchart showing operations when an ice maker water supply signal is generated during the drain mode of a refrigerator.

As shown in FIG. 8, the drain mode operation may be started under the control of the controller 17. [S100]

In a state where the water supply valve 141 and the drain valve 47 are opened and the inside of the water supply flow path 40 is being cleaned and drain is being performed through the drain pipe 44, the water supply signal for the ice maker 50 may be input. Of course, when the water supply signal for the ice maker 50 is not generated, the controller 17 may perform control such that the drain mode operation [S100] has been completed. [S210]

When the water supply signal for the ice maker 50 is input during the drain mode operation, the controller 17 may wait to supply water to the ice maker 50. That is, even when a water supply signal for the ice maker 50 is input, the controller 17 may maintain the open state of the water supply valve 141 and the drain valve 47 to continuously perform the drain mode operation. [S220]

Then, the controller 17 may determine whether the drain mode operation has been completed. In this case, whether the drain mode operation has been completed may be determined as in the above-described step [S130]. [S230]

When the controller 17 determines that the drain mode operation has been completed, the controller 17 may release a standby state for the water supply to the ice maker 50. [S240]

Then, the controller 17 may close the drain valve 47 and open the ice maker valve 46. In other words, discharge of water through the drain pipe 44 is terminated, and water supply to the ice maker 50 is started through the ice maker pipe 43. [S250]

The controller 17 may supply a fixed amount of water to the ice maker 50 and then end the water supply. After the supply of water to the ice maker 50 is terminated, the water supply valve 141 and the ice maker valve 46 may be closed. [S260]

When the water supply to the ice maker 50 has been completed, the controller 17 may wait in a normal operation state. In this state, the water supply valve 141, the ice maker valve 46, and the drain valve 47 may be all maintained in a closed state and wait for the next operation. [S150]

Hereinafter, an operating state in the case of input of the drain signal when water supply to the ice maker 50 has started will be described with reference to the drawings.

Figure 9:
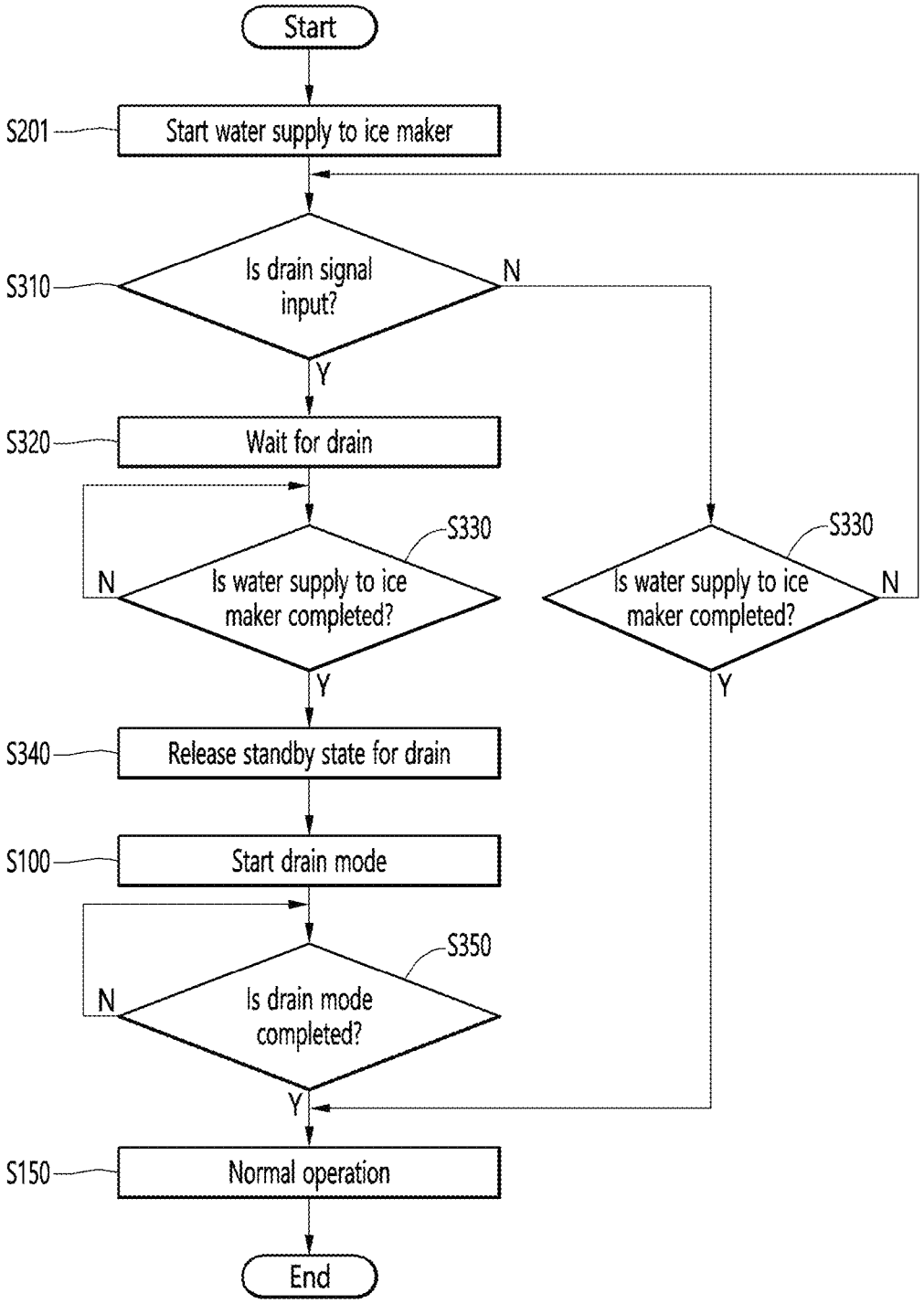
FIG. 9 is a flowchart showing operations when a drain signal is generated during an ice maker water supply mode of a refrigerator.

FIG. 9 is a flowchart showing operations when a drain signal is generated during an ice maker water supply mode of a refrigerator.

As shown in FIG. 9, when a water supply signal for the ice maker 50 is input to the controller 17, water in the water supply flow path 40 may be supplied to the ice maker 50 through the ice maker pipe 43. [S201]

Then, the controller 17 may determine whether a drain signal is input. The drain signal may be input to the controller 17 even while water is being supplied to the ice maker 50. Of course, when the drain signal is not input to the controller 17, the controller 17 may continuously supply water until a set amount of water is supplied to the ice maker 50. [S310]

When the drain signal is input while water is being supplied to the ice maker 50, the controller 17 may wait for drain mode operation. That is, the drain valve 47 may be maintained in a closed state, and the water supply valve 141 and the ice maker valve 46 may be maintained in an opened state to maintain water supply to the ice maker 50. [S320]

The controller 17 may determine whether the set amount of water has been supplied to the ice maker 50 while the drain mode operation is on standby. The controller 17 may maintain the supply of water to the ice maker 50 when the set amount of water is not supplied to the ice maker 50.

That is, when water supply to the ice maker 50 is started even when the drain mode operation is required, such as replacing a filter in the refrigerator 1, the water supply may be maintained to supply a fixed amount of water to the ice maker 50 until the water supply to the ice maker 50 has been completed. [S330]

When the fixed amount of water supply to the ice maker 50 has been completed, the controller 17 may close the water supply valve 141 and the ice maker valve 46. Then, the controller 17 may release the standby state for the drain mode operation. [S340]

After the standby state for the drain mode operation is released, the controller 17 may start the drain mode operation. The controller 17 may open the water supply valve 141 and the drain valve 47 to start draining water through the drain pipe 44. [S100]

After starting the drain mode operation, the controller 17 may determine whether the drain mode operation is completed. In this case, whether the drain mode operation is completed may be determined as in the above-described step [S130]. [S350]

When the drain mode operation is completed, the controller 17 may close the water supply valve 141 and the drain valve 47 and instruct the refrigerator 1 to perform normal operation. In this state, the water supply valve 141, the ice maker valve 46, and the drain valve 47 may all be closed and the controller 17 may wait for the next operation. [S150]

Meanwhile, the refrigerator 1 may perform a self-drain mode in which contaminated water in the water supply flow path 40 is drained and the inside of the water supply flow path 40 is cleaned in a state in which the ice maker 50 is not supplied with water for a long period of time. Hereinafter, the self-drain mode operation will be described with reference to the drawings.

Figure 10:
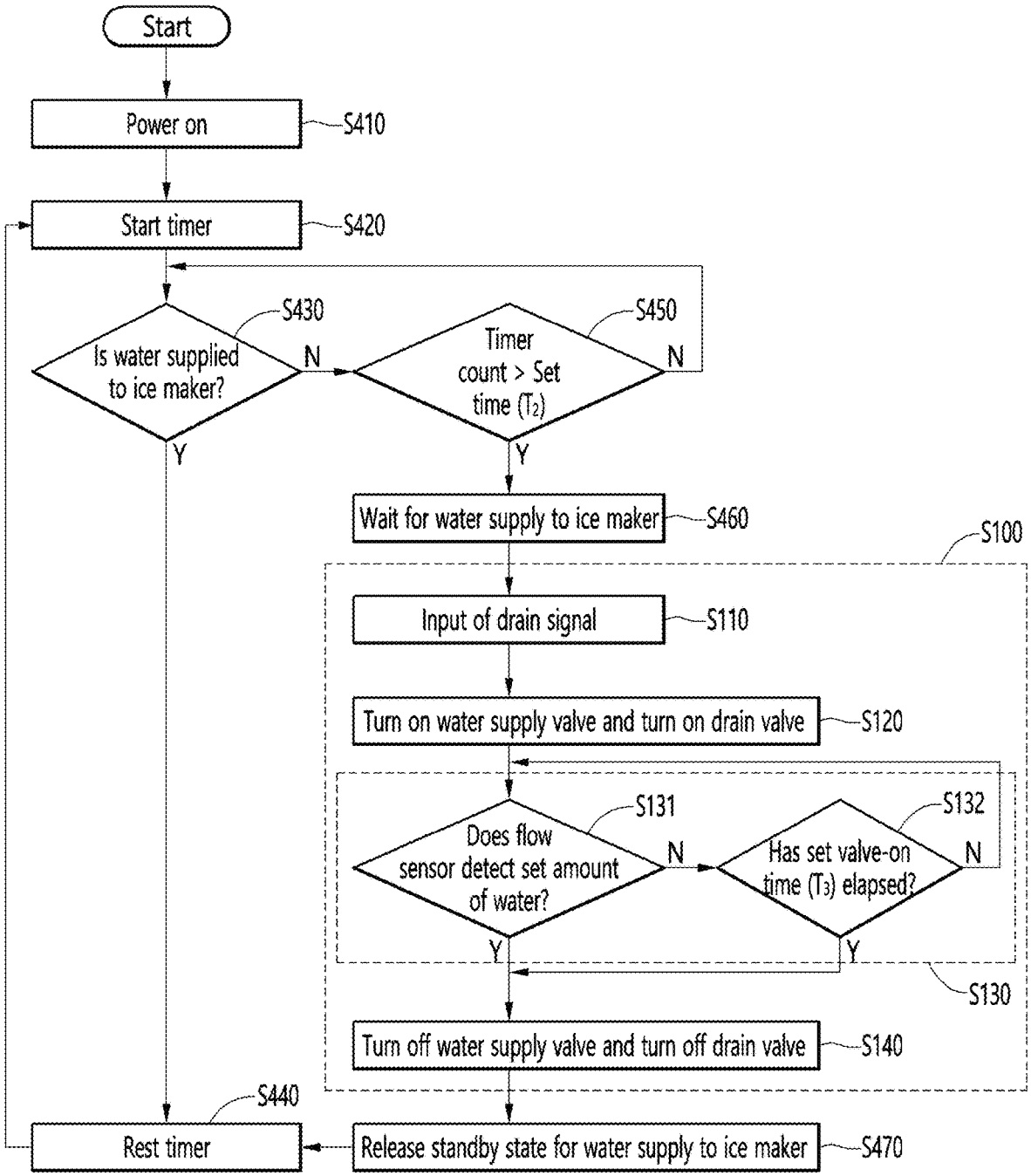
FIG. 10 is a flowchart showing operation of the self-drain mode of a refrigerator.

FIG. 10 is a flowchart showing operation of the self-drain mode of a refrigerator.

As shown in FIG. 10, the refrigerator 1 may start operating when power is supplied. [S410]

When power is supplied to the refrigerator 1, the timer 171 may be operated. The timer 171 may count time, and in particular, count an interval between water supplies to the ice maker 50. [S420]

In addition, the controller 17 may determine whether water is supplied to the ice maker 50. When a water supply signal for the ice maker 50 is input, the controller 17 may perform control such that water is supplied to the ice maker 50. [S430]

When water supply to the ice maker 50 is completed, the timer 171 may be reset. In addition, the timer 171 may start counting again after being reset. The timer 171 may count the time until the next water supply is performed after the water supply to the ice maker 50 has been completed. Therefore, the elapsed time after supplying water to the ice maker 50 may be determined through the counted time of the timer 171. [S440]

Meanwhile, when it is determined that water is not supplied to the ice maker 50, the controller 17 may determine whether the counted time of the timer 171 has elapsed a set time T2. For example, the set time T2 may be approximately 15 days.

Accordingly, when water is not supplied to the ice maker 50 for the set time T2, the controller 17 may determine that the inside of the water supply flow path 40 is contaminated. When water remains stagnant in the water supply flow path 40 for several days or more, the smell of the filter 30 and the pipe itself may permeate into the water stagnant in the water supply flow path 40 and become contaminated. When water in the above-described state is supplied to the ice maker 50, the frosted ice may have an odor, which may lead to user dissatisfaction.

In order to prevent this problem, the controller 17 may determine whether water has been supplied to the ice maker 50 for the set time T2 or longer through the counted time of the timer 171. [S450]

When it is determined that the counted time of the timer 171 has elapsed by more than the set time T2, the controller 17 may wait for water supply to the ice maker 50. That is, the controller 17 may maintain the ice maker valve 46 in the closed state such that water is not supplied to the ice maker 50. [S460]

In addition, the controller 17 may perform the drain mode operation [S100] to sufficiently drain the water in the water supply flow path 40. The drain mode operation may be the same as the drain mode operation as described above.

It should be noted that the controller 17 may open the water supply valve 141 and the drain valve 47 according to the input of the drain signal [S110] to allow water to be drained through the drain pipe 44. [S120] In this case, the input of the drain signal may be automatically generated by the controller 17 based on the counted time of the timer 171. Therefore, the above-described operation may be referred to as self-drain mode operation.

Furthermore, the controller 17 may determine whether the drain mode operation is completed. In this case, whether the drain mode operation is completed may be the same as the above-described step [S130]. A set amount of water for determining completion of the drain may be 500 ml, and a pulse value detected by the flow sensor may be 2,000, which may be relatively smaller than those of the drain mode operation in the case of replacing the filter 30 as described above. In addition, the set time T3 for determining completion of the drain may be approximately 3 minutes, which may be relatively shorter than that of the drain mode operation in the case of replacing the filter 30 as described above. Since the purpose of the self-drain mode operation is to drain contaminated water in the water supply flow path 40 and fill the water supply flow path 40 with new water, it will be sufficient to drain a relatively small amount of water for a short time. [S130]

The controller 17 may determine that the drain mode operation is completed when the set amount of water is drained or the water is drained for more than the set time T3, and close the water supply valve 141 and the drain valve 47. [S140]

When the drain mode operation is completed, the controller 17 may release a standby state for water supply to the ice maker 50. That is, the controller 17 may wait in a state in which water can be supplied when a water supply signal is input from the ice maker 50. [S470]

After completion of the drain mode operation, the timer 171 may be reset and perform counting again.

Meanwhile, various other embodiments of the present disclosure may be possible in addition to the above-described embodiments. Another embodiment of the present disclosure is characterized in that the valve connecting the outlet of the filter and the ice maker pipe and the drain pipe is composed of one switching valve. Another embodiment of the present disclosure may be the same as the above-described embodiment with only a difference in the arrangement of the switching valve. Accordingly, the same configuration as the above-described embodiment may be indicated using the same reference numeral and a detailed description or illustration thereof may be omitted.

Hereinafter, another embodiment of the present disclosure will be described with reference to the drawings.

Figure 11:
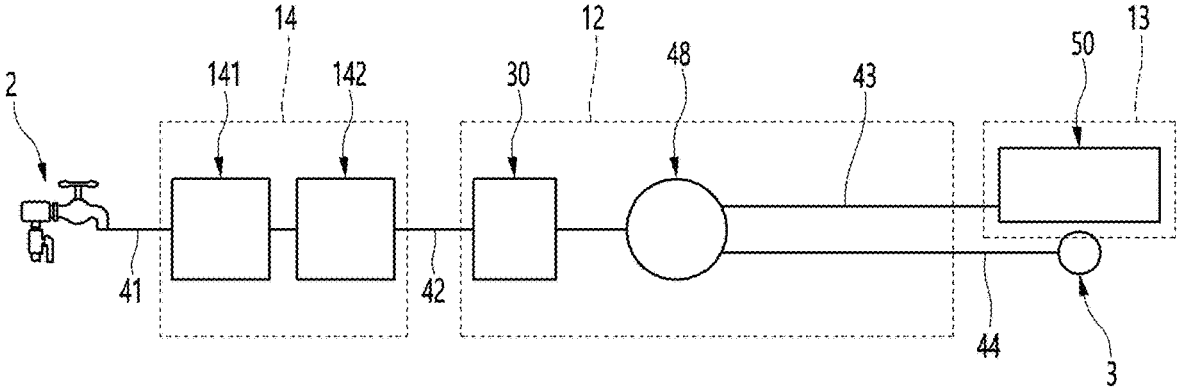
FIG. 11 is a diagram schematically showing the overall flow path connection state and water flow state of a refrigerator according to another embodiment of the present disclosure.

FIG. 11 is a diagram schematically showing the overall flow path connection state and water flow state of a refrigerator according to another embodiment of the present disclosure.

As shown in FIG. 11, the water supply source 2 and the ice maker 50 in the refrigerator 1 may be connected through a water supply flow path 40. In addition, the filter 30 may be connected to the water supply flow path 40, and the water supply valve 141, the flow sensor 142, and the switching valve 48 may be connected to water supply flow path 40 to allow a fixed amount of purified water to be supplied to the ice maker 50 to perform the drain mode operation.

In addition, the water supply flow path 40 may include the water supply pipe 41 connecting the water supply source 2 and the water supply valve 141 and the filter pipe 42 connecting the water supply valve 141 or the flow sensor 142, and the filter 30. The water supply flow path 40 may include the ice maker pipe 43 connected to the ice maker 50 and the drain pipe 44 for drain.

The switching valve 48 may be provided at the outlet of the filter pipe 42. The switching valve 48 may have two switchable outlets, and may be connected to the ice maker pipe 43 and the drain pipe 44.

The switching valve 48 may be provided inside the refrigerating compartment 12 adjacent to the position of the filter 30 provided in the refrigerating compartment 12. In addition, components of the water supply flow path 40, except for the switching valve 48, may have the same arrangement structure as the above-described embodiment in the cabinet 10.

The switching valve 48 may allow water purified by the filter 30 to flow into the ice maker 50 when water is supplied to the ice maker 50. In this case, the switching valve 48 may be maintained in a closed state with respect to the side of the drain pipe 44.

In addition, during the drain mode operation, water that has passed through the filter 30 may be drained through the drain pipe 44. In this case, the switching valve 48 may be maintained in a closed state with respect to the side of the ice maker pipe 43.

The switching valve 48 may not only change the direction of the flow path, but also maintain both the ice maker pipe 43 and the drain pipe 44 in a closed state.

Of course, the switching valve 48 may simply function to change the direction of the flow path, and the actual start and stop of water supply may be performed through the water supply valve 141.

Meanwhile, the present disclosure may have various other embodiments in addition to the above-described embodiments. Another embodiment of the present disclosure is characterized in that the filter is provided outside the refrigerator rather than inside the refrigerator and is connected to the water supply flow path. Another embodiment of the present disclosure may be the same as the above-described embodiment with only a difference in the arrangement of the filter. Accordingly, the same configuration as the above-described embodiment may be indicated using the same reference numeral and a detailed description or illustration thereof may be omitted.

Hereinafter, another embodiment of the present disclosure will be described with reference to the drawings.

Figure 12:
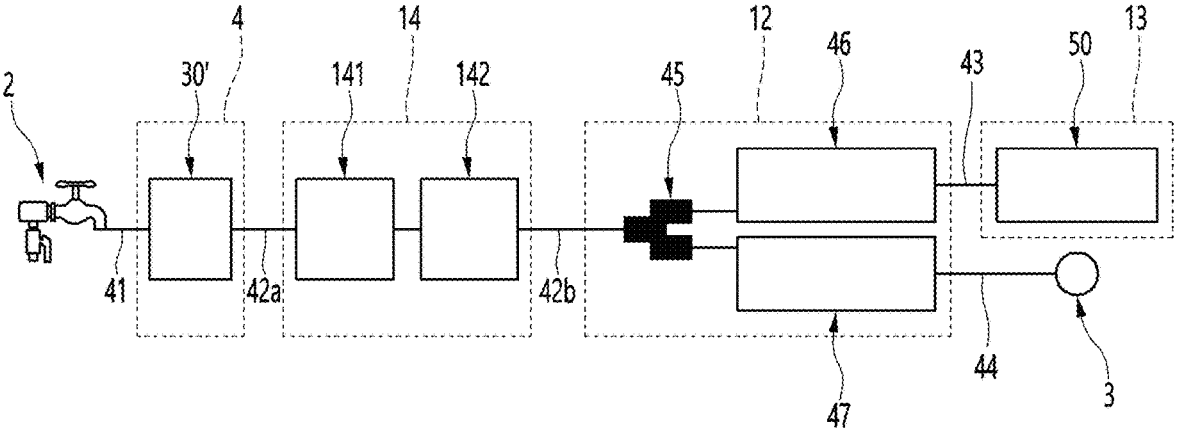
FIG. 12 is a diagram schematically showing the overall flow path connection state and water flow state of a refrigerator according to another embodiment of the present disclosure.

FIG. 12 is a diagram schematically showing the overall flow path connection state and water flow state of a refrigerator according to another embodiment of the present disclosure.

As shown in FIG. 12, the water supply source 2 and the ice maker 50 inside the refrigerator 1 may be connected by a water supply flow path 40. In addition, The filter 30' may be connected to the water supply flow path 40, and the water supply valve 141, the flow sensor 142, the ice maker valve 46, and the drain valve 47 may be provided to allow a fixed amount of purified water to be supplied to the ice maker 50 to perform the drain mode operation.

Meanwhile, unlike the above-described embodiment, the filter 30' may be separately placed outside the refrigerator 1. For example, the filter 30' may be an under-sink filter disposed inside the sink 4, and may be connected to the refrigerator through the water supply flow path 40. As another example, the filter 30 may be placed inside a water purifier, and may be connected to the water supply flow path 40 and shared for the water purification of both the water purifier and the refrigerator 1. Even in the arrangement as described above, the filter 30' may be replaced, and thus the drain operation mode operation may be necessary.

The water supply flow path 40 may include the water supply pipe 41 connecting the water supply source 2 and the filter 30' outside the refrigerator, a first filter pipe 42*a* connecting the filter 30 and the water supply pipe 41, a second filter pipe 42*b* connecting the water supply valve 141 or the flow sensor 142 and the branch pipe 45, the ice maker pipe 43 connected to the ice maker 50, and the drain pipe 44 for drain.

The ice maker pipe 43 and the drain pipe 44 may be connected to the branch pipe 45. In addition, the ice maker pipe 43 may be provided with the ice maker valve 46. Also, the drain pipe 44 may be provided with the drain valve 47.

Accordingly, the water supplied from the water supply source 2 may be purified by the filter 30' outside the refrigerator 1 and then pass through the water supply valve 141, the flow sensor 142, and the branch pipe 45. Also, when the drain valve 47 is closed and the ice maker valve 46 is opened, a fixed amount of water may be supplied to the ice maker 50 through the ice maker pipe 43.

In addition, when the drain mode operation is necessary, the ice maker valve 46 may be closed, the drain valve 47 may be opened, and water passing through the branch pipe 45 may be drained into the sewer 3 through the drain pipe 44.

What is claimed is:

1. A refrigerator comprising:

a cabinet having a storage space therein;

a door configured to open and close at least a portion of the storage space;

an ice maker disposed at the cabinet or the door;

a water supply flow path configured to connect the ice maker to a water supply source disposed outside the cabinet, the water supply flow path being configured to connect to a filter that is configured to purify water to be supplied to the ice maker;

at least one valve disposed at the water supply flow path;

a flow sensor disposed at the water supply flow path; and a controller configured to control the ice maker and the at least one valve, wherein the water supply flow path comprises:

an ice maker pipe connected to the ice maker and configured to supply water for making ice, and a drain pipe configured to drain water in the water supply flow path to an outside of the cabinet, and wherein the controller is configured to, based on receiving a drain signal, control the at least one valve to block water from being supplied to the ice maker and to drain water through the drain pipe, and wherein the controller is configured to stop draining water through the drain pipe based on an amount of water detected by the flow sensor.

2. The refrigerator of claim 1, wherein the at least one valve comprises:

an ice maker valve disposed at the ice maker pipe; and a drain valve disposed at the drain pipe.

3. The refrigerator of claim 2, wherein the storage space comprises a refrigerating compartment defined inside the cabinet, and wherein the ice maker valve and the drain valve are disposed at the refrigerating compartment.

4. The refrigerator of claim 3, wherein the water supply flow path is configured to connect to the filter disposed inside the refrigerating compartment.

5. The refrigerator of claim 1, wherein the water supply flow path is configured to connect the filter disposed outside the cabinet to the water supply source and the cabinet.

6. The refrigerator of claim 1, wherein the at least one valve comprises a switching valve connected to the ice maker pipe and the drain pipe, and wherein the controller is configured to control the switch valve to switch flow of water through the water supply flow path to one of the ice maker pipe or the drain pipe.

7. The refrigerator of claim 6, wherein the at least one valve further comprises a water supply valve configured to be disposed between the water supply source and the filter, the water supply valve being configured to open and close a portion of the water supply flow path between the water supply source and the filter.

8. The refrigerator of claim 1, wherein the cabinet comprises (i) a refrigerating compartment configured to accommodate the filter, (ii) a freezing compartment configured to accommodate the ice maker, and (iii) a machine room that accommodates a compressor, wherein the at least one valve comprises:

a water supply valve disposed at the machine room, the water supply valve being configured to communicate with an outlet side of the water supply source, an ice maker valve disposed at the refrigerating compartment and connected to the ice maker pipe, and a drain valve disposed at the refrigerating compartment and connected to the drain pipe, and wherein each of the ice maker pipe and the drain pipe passes through a rear side of the cabinet.

9. The refrigerator of claim 1, further comprising:

an operating interface configured to receive input from a user, wherein the controller is configured to, based on the user operating the operating interface, control the at least one valve to drain water through the drain pipe.

10. The refrigerator of claim 1, wherein the drain pipe extends to the outside of the cabinet through a rear side of the cabinet.

11. A refrigerator comprising:

a cabinet having a storage space therein;

a door configured to open and close at least a portion of the storage space;

an ice maker disposed at the cabinet or the door;

a water supply flow path configured to connect the ice maker to a water supply source disposed outside the cabinet, the water supply flow path being configured to connect to a filter that is configured to purify water to be supplied to the ice maker;

at least one valve disposed at the water supply flow path;

a controller configured to control the ice maker and the at least one valve; and a timer configured to count time, wherein the water supply flow path comprises:

an ice maker pipe connected to the ice maker and configured to supply water for making ice, and a drain pipe configured to drain water in the water supply flow path to an outside of the cabinet, wherein the controller is configured to, based on receiving a drain signal, control the at least one valve to block water from being supplied to the ice maker and to drain water through the drain pipe, and wherein the controller is configured to stop draining water through the drain pipe based on an elapse of the time counted by the timer more than a set time after starting to drain the water through the drain pipe.

12. The refrigerator of claim 11, wherein the cabinet comprises (i) a refrigerating compartment configured to accommodate the filter, (ii) a freezing compartment configured to accommodate the ice maker, and (iii) a machine room that accommodates a compressor, wherein the at least one valve comprises:

a water supply valve disposed at the machine room, the water supply valve being configured to communicate with an outlet side of the water supply source, an ice maker valve disposed at the refrigerating compartment and connected to the ice maker pipe, and a drain valve disposed at the refrigerating compartment and connected to the drain pipe, and wherein each of the ice maker pipe and the drain pipe passes through a rear side of the cabinet.

13. The refrigerator of claim 11, further comprising:

an operating interface configured to receive input from a user, wherein the controller is configured to, based on the user operating the operating interface, control the at least one valve to drain water through the drain pipe.

14. The refrigerator of claim 11, wherein the drain pipe extends to the outside of the cabinet through a rear side of the cabinet.

15. A refrigerator comprising:

a cabinet having a storage space therein;

a door configured to open and close at least a portion of the storage space;

an ice maker disposed at the cabinet or the door;

a water supply flow path configured to connect the ice maker to a water supply source disposed outside the cabinet, the water supply flow path being configured to connect to a filter that is configured to purify water to be supplied to the ice maker;

at least one valve disposed at the water supply flow path;

a controller configured to control the ice maker and the at least one valve; and a detector configured to detect the filter, wherein the water supply flow path comprises:

an ice maker pipe connected to the ice maker and configured to supply water for making ice, and a drain pipe configured to drain water in the water supply flow path to an outside of the cabinet, wherein the controller is configured to, based on receiving a drain signal, control the at least one valve to block water from being supplied to the ice maker and to drain water through the drain pipe, and wherein the controller is configured to control the at least one valve to drain the water through the drain pipe based on the detector detecting the filter.

16. The refrigerator of claim 15, wherein the controller is configured to drain water through the drain pipe based on water not being supplied for more than a set time after starting to supply the water to the ice maker.

17. The refrigerator of claim 16, further comprising a timer configured to count time.

18. The refrigerator of claim 15, wherein the drain pipe extends to the outside of the cabinet through a rear side of the cabinet.

* * * * *